United States Patent [19]

Rüdenauer et al.

[11] Patent Number: 4,998,476

[45] Date of Patent: Mar. 12, 1991

[54] FUZE FOR A BOMBLET

[75] Inventors: Werner Rüdenauer, Roth; Fritz Müller, Nuremberg; Joachim Furtmayr, Erlangen, all of Fed. Rep. of Germany

[73] Assignee: Diehl GmbH & Co., Nuremberg, Fed. Rep. of Germany

[21] Appl. No.: 503,874

[22] Filed: Apr. 3, 1990

[30] Foreign Application Priority Data

Apr. 18, 1989 [DE] Fed. Rep. of Germany ..... 3912671

[51] Int. Cl.[5] ..... F42C 9/06; F42C 9/16

[52] U.S. Cl. ..... 102/226; 102/230; 102/266

[58] Field of Search ..... 102/226, 227, 229, 230, 102/254, 256, 266, 272, 274

[56] References Cited

U.S. PATENT DOCUMENTS

| | | | |
|---|---|---|---|
| 2,896,540 | 7/1959 | Voland | 102/266 |
| 3,926,122 | 12/1975 | Wolterman | 102/226 |
| 3,998,164 | 12/1976 | Hadfield | 102/226 |
| 4,653,401 | 3/1987 | Gatti | 102/226 |
| 4,762,066 | 8/1988 | Rudenauer et al. | 102/226 |
| 4,811,664 | 3/1989 | Levy et al. | 102/226 |
| 4,873,927 | 10/1989 | Rudenauer | 102/226 |
| 4,901,643 | 2/1990 | Rudenauer et al. | 102/256 |

*Primary Examiner*—David H. Brown

*Attorney, Agent, or Firm*—Scully, Scott, Murphy & Presser

[57] ABSTRACT

A fuze for a bomblet including a slider in which there is arranged a detonator triggered in response to an impact or percussion, and which undergoes a transition during the free flight of the bomblet from a safe or secured position into an armed position. Arranged in the slider is a hydraulic or penumatic cylinder-piston retarding device and a spring-biased self-destruct pin which is operatively coupled to the device, which has a self-destruct detonator associated therewith, wherein the retarding device is blocked until the slider is generally located in the armed position thereof, and in which the retarding device, in the armed position of the slider, will brake the movement of the self-destruct pin during a self-destruct time period and thereafter will cause the releast of the latter.

6 Claims, 5 Drawing Sheets

FUZE FOR A BOMBLET

BACKGROUND OF THE INVENTION

1. Field of the Invention

The present invention relates to a fuze for a bomblet including a slider in which there is arranged a detonator triggered in response to an impact or percussion, and which undergoes a transition during the free flight of the bomblet from a safe or secured position into an armed position.

2. Discussion of the Prior Art

Fuzes of that type are brought into their armed positions in that a stabilizing band which unfolds during the flight of the bomblet brings a firing pin and the detonator which is associated therewith into a position from which a triggering or detonation can result upon the impact of the bomblet. A self-destructing action for the bomblet should be contemplated for the case in which the impact or percussion detonation fails to take place upon impact against a target.

SUMMARY OF THE INVENTION

Accordingly, it is an object of the present invention to propose a fuze of the above-mentioned type which possesses a compact construction, wherein a delay period up to self-destruction only commences with the slider being the armed position thereof.

Inventively, the above-mentioned object is attained with a fuze of the above-mentioned type in that there is arranged in the slider a hydraulic or pneumatic cylinder-piston retarding device and a spring-biased self-destruct pin which is operatively coupled to the device, which has a self-destruct detonator associated therewith, wherein the retarding device is blocked until the slider is generally located in the armed position thereof, and in which the retarding device, in the armed position of the slider, will brake the movement of the self-destruct pin during a self-destruct time period and thereafter will cause the release of the latter.

Hereby, in effect, the self-destruct time period only begins with the armed positioning of the slider for effectuating an impact or percussion detonation. Accordingly, the self-destruct time period does not have to be calculated so as to have to incorporate therein any time cycles which are prior to this point in time; for example, such as the unfolding of the stabilizing band. Consequently, there can be achieved with only minor demands on additional structure and in a compact mode of construction, that the self-destruction will dependably only take place after a sufficiently lengthy period of time has elapsed subsequent to an impact or striking of the bomblet. It is also expedient when the self-destruction is extensively independent of the effects of temperature.

Pursuant to a preferred embodiment of the invention, the retarding device is coupled to the self-destruct pin through the interposition of a lever which is pivotably supported on the slider, whereby the lever will release the self-destruct pin subsequent to a pivoting action corresponding to the self-destruct period. The lever allows for a structurally compact positioning for the retarding device and the self-destruct pin within the slider. Through the specified positioning of the point of rotation for the lever it is possible to achieve a correlation between the movements of the self-destruct pin and the retarding device.

BRIEF DESCRIPTION OF THE DRAWINGS

Further advantageous embodiments of the invention and advantageous features thereof may now be more readily ascertained from the following detailed description of an exemplary embodiment of a fuze for a bomblet, taken in conjunction with the accompanying drawings; in which.

DETAILED DESCRIPTION

Figure 1:
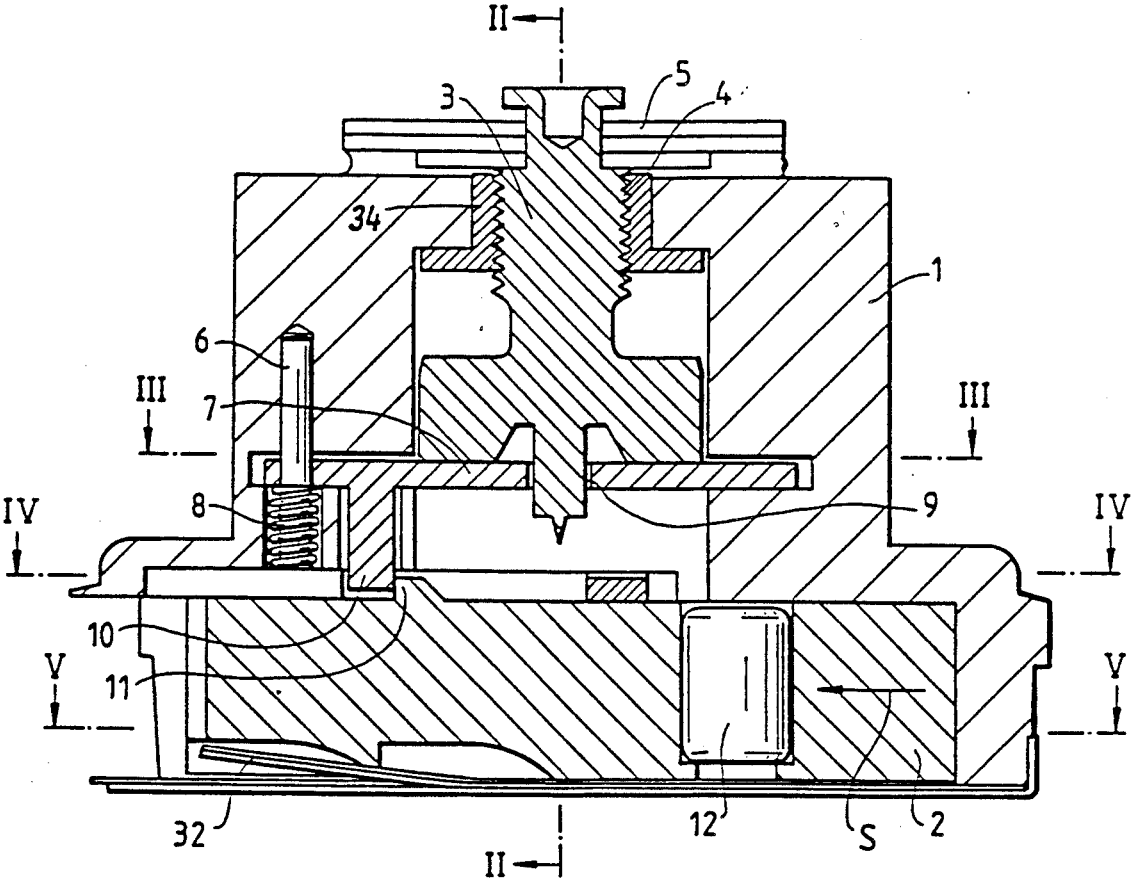
FIG. 1 illustrates a sectional view through the fuze of a bomblet, shown in the secured or safe position thereof.
Figure 2:
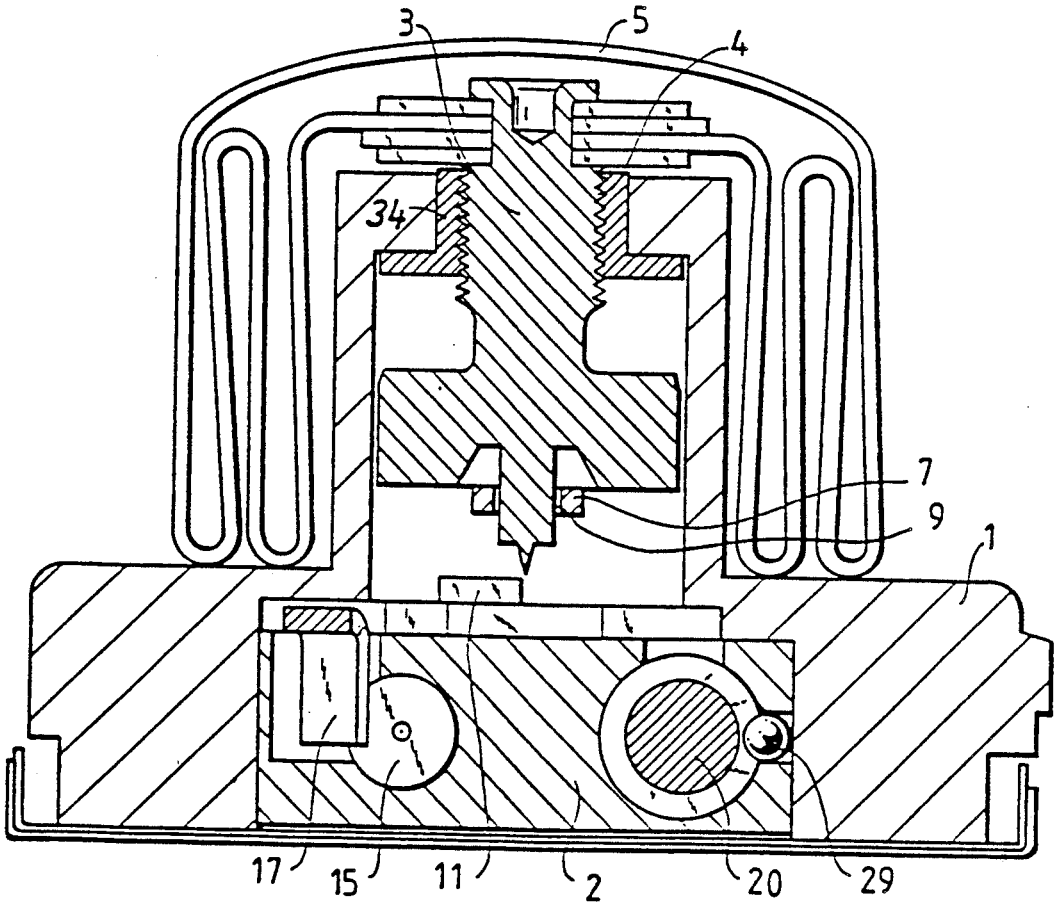
FIG. 2 illustrates a sectional view taken along line II—II in FIG. 1.

A slider 2 is supported within a housing 1 so as to be displaceable along the direction of the arrow S. A firing pin 3 possessing a screwthread 4 is screwed into a threaded sleeve 34, which is supported in the housing 1 so as to be secured against rotation and being axially displaceable. The firing pin 3 is fastened to a stabilizing band 5.

In the housing 1 there is supported a securing lever 7 so as to be pivotable about an axle member 6. A coil spring 8 engages the lever 7. In the secured position, the firing pin 3 projects through an opening 9 which is formed in the securing lever 7, and a locking pin 10 on the securing lever 7 blocks the slider at its contacting against a protuberance 11.

A detonator 12 is arranged in the slider 2, whereby the detonator has the firing pin 3 operatively associated therewith. Supported within the slider 2 is a compression spring 13 which contacts against the housing 1, as shown in FIG. 5.

Arranged in the slider 2 is a self-destruct detonator 14, which has a self-destruct pin 15 associated therewith. This pin supports itself within the slider 2 by means of a compression spring 16. The pin is retained by one arm 17 of a lever 18 whose other arm 19 contacts against a piston 20 of a retarding device 21.

Figure 5:
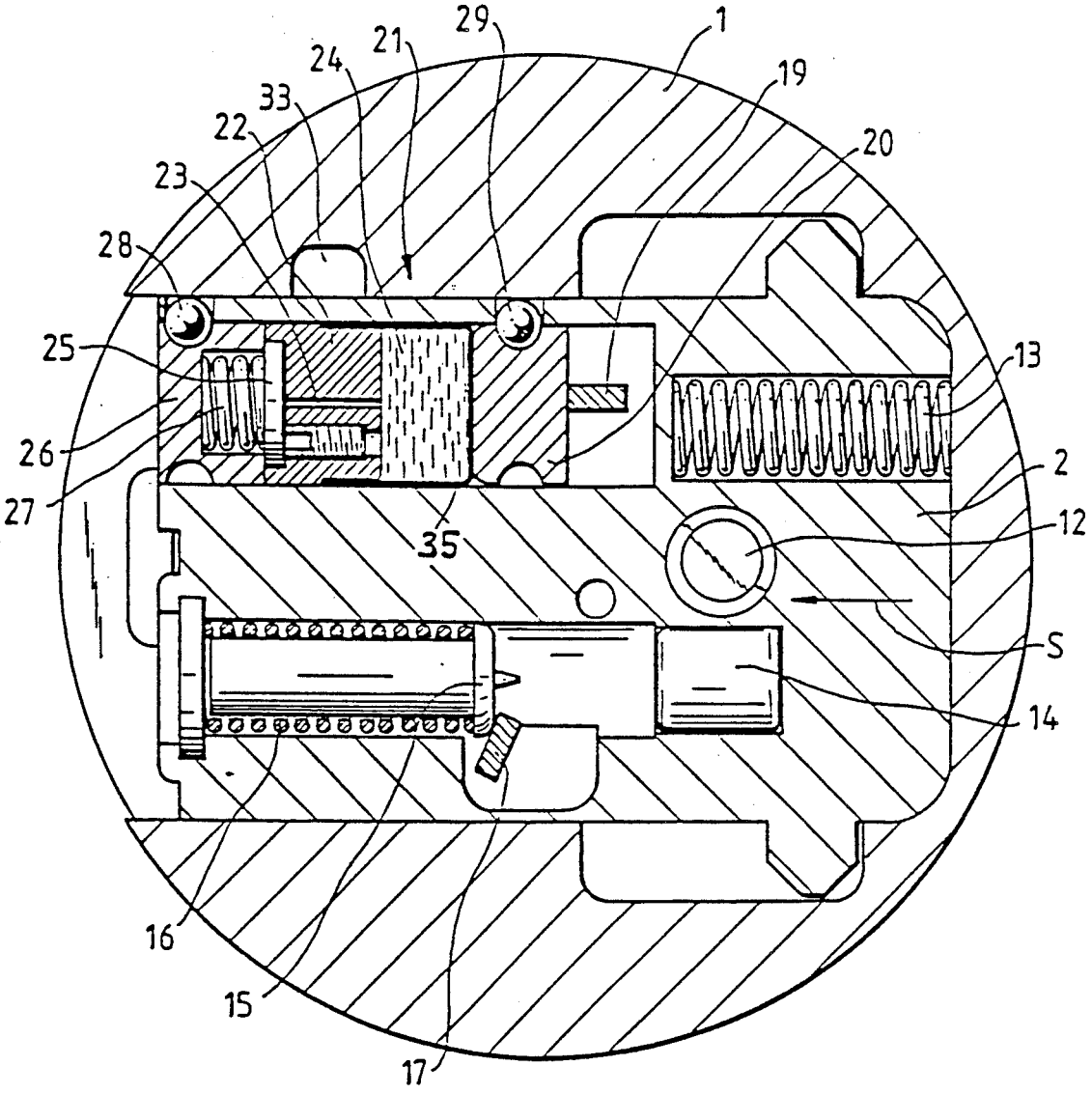
FIG. 5 illustrates a sectional view taken along line V—V in FIG. 1.

The retarding device 21 is similarly arranged within the slider 2, as shown in FIG. 5. The device includes a nozzle body 22 with a nozzle 23 and which is fixedly seated in the slider 2. Tightly mounted on this nozzle 23 is a cup 35 constituted from a flexible plastic material and which is filled with a hydraulic fluid medium 24. The hydraulic fluid medium 24 is secured in the plastic cup 35 against leakage and any drying out effects. In the safe or secured position, the nozzle 23 is closed off by a disc 25 which is pressed by means of a blocking element 26 against the nozzle body 22. Arranged intermediate the blocking member 26 and the disc 25 is a compression spring 27. In the secured position, the blocking element 26 is blocked by means of a ball 28 and the piston 20 by means of a ball 29 on the slider 2, such that, through the use of the lever 18, the self-destruct pin 15 is maintained at a spacing from the self-destruct detonator 14.

Figure 3:
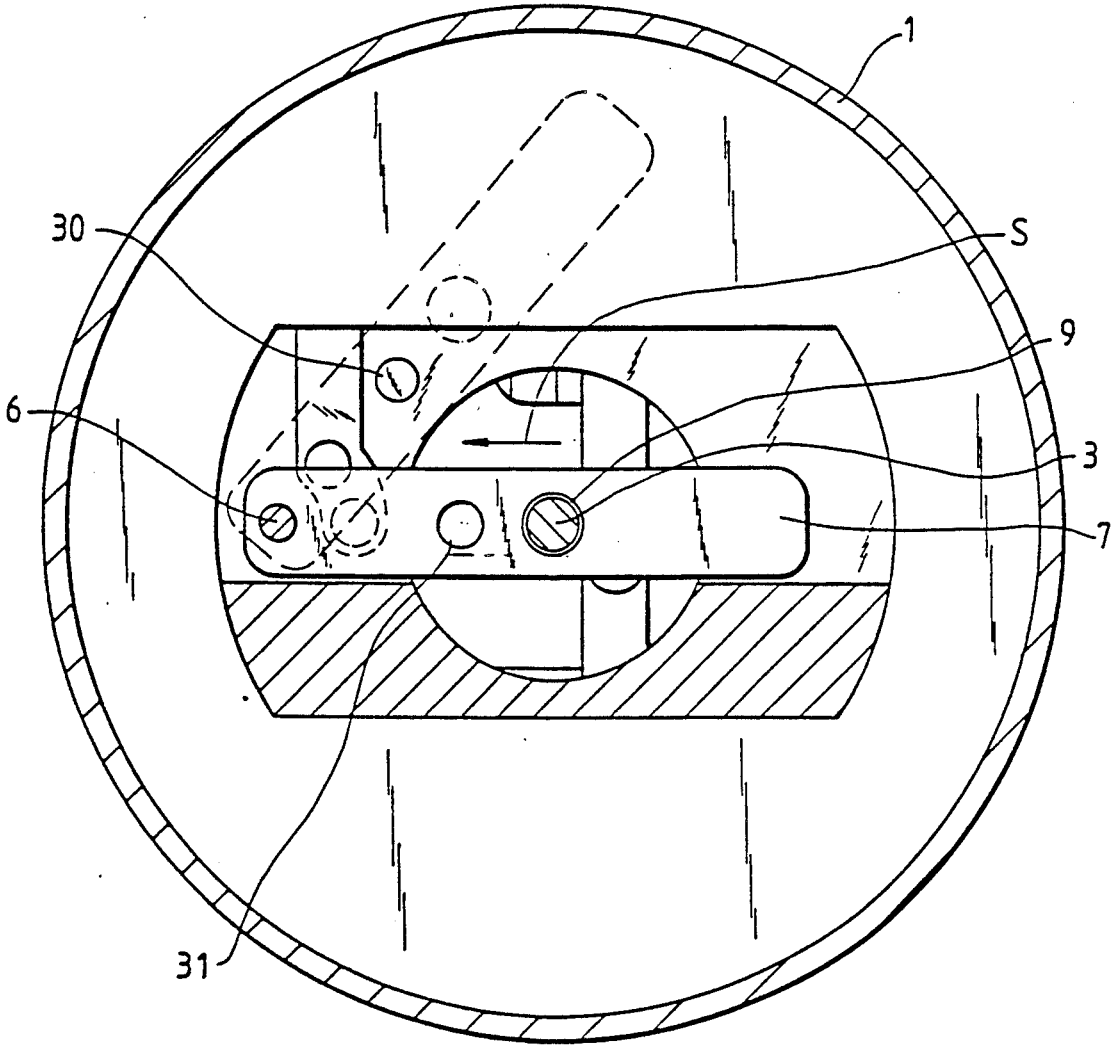
FIG. 3 illustrates a sectional view taken along line III—III in FIG. 1.
Figure 4:
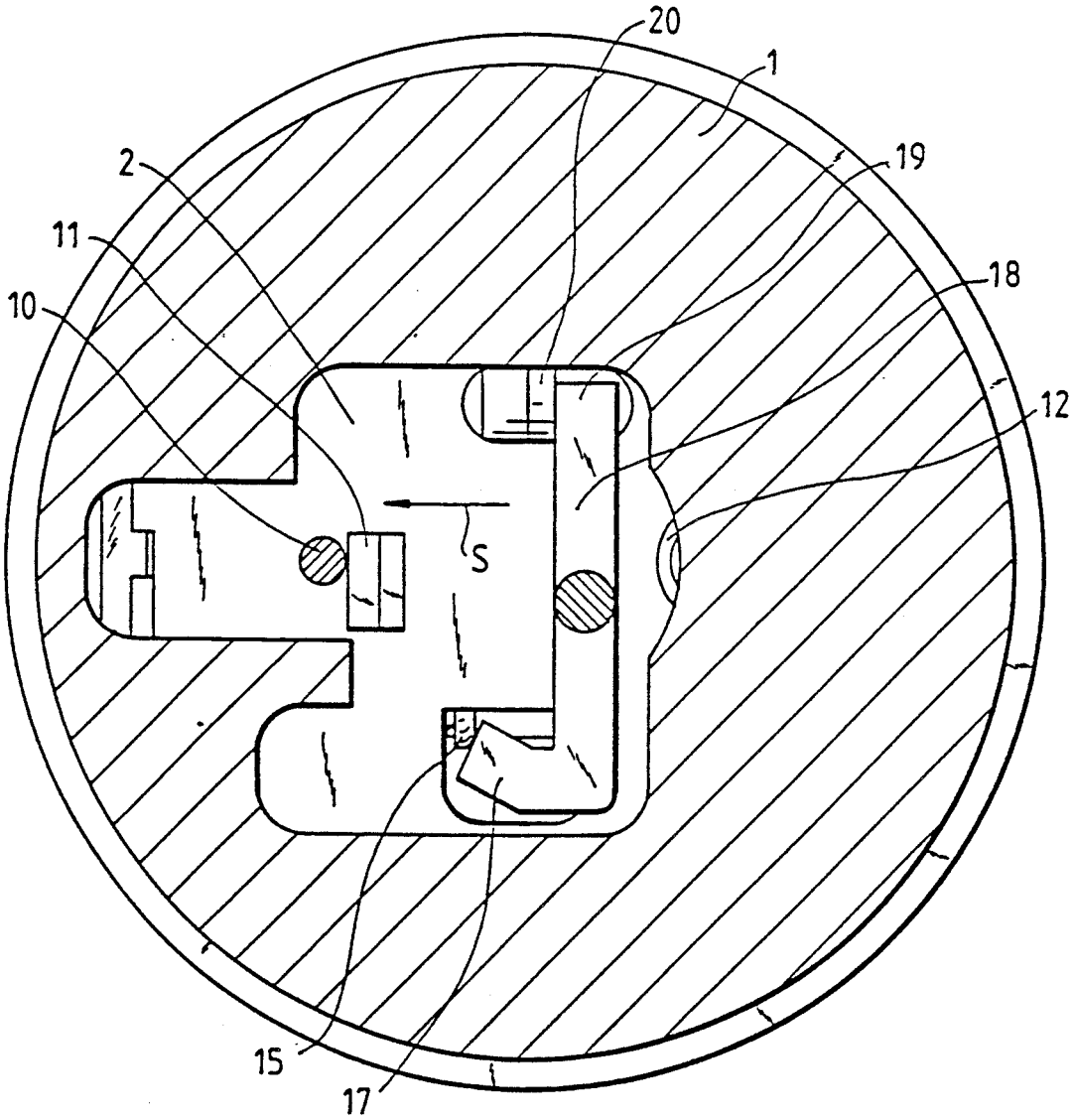
FIG. 4 illustrates a sectional view taken along line IV—IV in FIG. 1.

After the ejection of the bomblet containing the above-described arrangement, the stabilizing band 5 unfolds. In consequence thereof, the firing pin 3 is screwed out of the screwthread 4. The firing pin exits from the opening 9 provided in the securing lever 7 so that the latter, under the action of the coil spring 18, swings out of the path of movement of the firing pin 3, as shown in FIG. 3. Hereby, the locking pin 10 removes itself from the protuberance 11. The securing lever 7 is locked in its outwardly pivoted position by means of a spring pin 30 which is supported against the housing 1, and which snaps into a bore 31 provided in the securing lever 7.

Through the removal of the locking pin 10 from the protuberance 11, the slider 2 is then freed, and is pressed by the compression spring 13 along the direction of the arrow S into the direction of its armed position. At the beginning of this movement, the ball 28 is freed and the blocking element 26 is ejected out of the housing 1 by the compression spring 27. The disc 25 drops down so that the nozzle 23 is now open.

Upon the reaching of the armed position by the slider 2, the detonator 12 then stands below the firing pin 3, whereby the fuze is in readiness for an impact or percussion detonation. In the armed position, the slider 2 is locked by means of a spring plate 32, as shown in FIG. 1.

Upon the reaching of the armed position, the ball 29 deviates into a recess 33, as shown in FIG. 5. The piston 20 is thereby freed. The compression spring 16 presses the self-destruct pin 15 against the arm 17 of the lever 18. The arm 19 of the lever 17 presses against the piston 20, which now pushes out the hydraulic fluid medium 24 contained in the flexible plastic material cup 35 out through the nozzle 23. This determines the self-destruct period. After subtending a predetermined pivoting angle, the arm 17 of the lever 18 is displaced out of the path of movement of the self-destruct pin 15. As a result thereof, this determines the end of the self-destruct period. The self-destruct pin 15 will then strike the self-destruct detonator 14 in response to the force from the compression spring 16.

We claim:

1. Fuze for a bomblet including a slider; a detonator for an impact detonation being arranged in the slider so as to undergo a transition from a secured position into an armed position during the free flight of the bomblet; a hydraulic or pneumatic cylinder-piston retarding device; a spring-biased self-destruct pin in said slider; a lever which is pivotably supported on said slider coupling said self-destruct pin with the retarding device; a self-destruct detonator being operatively associated with the self-destruct pin, said retarding device being blocked until the slider is generally located in the armed position thereof, said retarding device in the armed position of the slider braking the movement of the self-destruct pin during a self-destruct period and thereafter, said lever releasing said self-destruct pin upon a pivoting of said lever in correlation with said self-destruct period.

2. A fuze as claimed in claim 1, wherein the lever contacts against the piston of said device.

3. A fuze as claimed in claim 1, wherein the piston in the secured position of the slider is blocked by a ball acting opposite the force of the lever.

4. A fuze as claimed in claim 1, wherein the retarding device includes a nozzle; and a blocking element closing off said nozzle until the slider leaves the secured position thereof.

5. A fuze as claimed in claim 4; wherein a ball arranged on said slider blocks the piston of the retarding device until the slider is located in the armed position thereof.

6. A fuze as claimed in claim 4, wherein hydraulic oil for the retarding device is arranged in a cup constituted from a flexible plastic material, said cup being mounted on said nozzle.

* * * * *